United States Patent [19]

Taragna

[11] 4,429,801

[45] Feb. 7, 1984

[54] TEAR-OFF CAP FOR CLOSING BOTTLES

[75] Inventor: Luigi Taragna, Aprilia, Italy

[73] Assignee: American Flange & Manufacturing Co. Inc., Linden, N.J.

[21] Appl. No.: 358,538

[22] Filed: Mar. 16, 1982

[51] Int. Cl.[3] ..... B65D 41/42

[52] U.S. Cl. ..... 215/254

[58] Field of Search ..... 215/254

[56] References Cited

U.S. PATENT DOCUMENTS 3,130,056 4/1964 Taylor et al. ..... 215/254 X 3,958,710 5/1976 Harding et al. ..... 215/254

FOREIGN PATENT DOCUMENTS 2752246 6/1978 Fed. Rep. of Germany ..... 215/254

2356570 1/1978 France ..... 215/254

*Primary Examiner*—Donald F. Norton

[57] ABSTRACT

A tear-off bottle cap formed of light metal material having a disc-shaped top panel surrounded by a circumferential flap. Two lines of incision are formed in the cap top and flap defining a tear-off band which commences in a radially extending pull-out tongue. A disc-shaped gasket is secured to portions of the cap top undersurface but not to the tear-off band to permit reuse of the torn open cap as a temporary cover.

4 Claims, 3 Drawing Figures

TEAR-OFF CAP FOR CLOSING BOTTLES

BACKGROUND OF THE INVENTION

The present invention concerns a tear-off cap for closing bottles. Caps for closing bottles are known made of light weight metal consisting of a disc-shaped top wall surrounded by a circumferential flap engaged about the lip of the bottle opening. Such caps include a central tear-off band that crosses the circumferential flap and extends beyond the flap edge in a pull-out tongue. Sealing of the closure is generally assured by the provision of either a disc-shaped or a ring-shaped gasket placed between the lip of the bottle and the undersurface of the cap top wall. In use, such caps must meet certain requirements among which are that the cap must be easily removable from the neck of the bottle and the cap must be temporarily reusable after initial tear-off.

In an attempt to satisfy these requirements which in practice give rise to contrasting problems, there has been proposed, as seen in British Pat. No. 1320490 published June 13, 1973, a cap with a disc-shaped gasket adhered to the undersurface of the cap top only within a zone diametrically opposite the pull-out tongue and arranged transversely of the tear-off band. In this construction the initial tear-off of the cap is not hindered by tearing through the gasket which instead remains intact and affords subsequent reuse of the cap itself.

One disadvantage with this solution resides in the fact that the reclosable nature of the cap for subsequent usage is basically dependent on the residual elasticity of the metal from which it is made. However, after two or three applications on the bottle, the residual elasticity of the metal is nearly used up and therefore the now unreliable reclosure continues to lose its effectiveness.

SUMMARY OF THE INVENTION

According to the invention, the problem is solved by a tear-off cap for closing bottles which is made of light metal with a circumferential flap and an overhanging flat disc-shaped part wherein there is a tear-off band which crosses the circumferential flap and extends beyond same in a pullout tongue, and consisting of a disc-shaped gasket fastened only partially to the bottom surface of the disc-shaped metal part, characterized by the fact that said disc-shaped gasket is fastened to said disc-shaped metal part corresponding to two zones outside the tear-off band.

In this way the advantage is obtained of having a reclosure that depends on the elasticity of the disc-shaped gasket, which not only does not weaken even after numerous reclosings, but also enables the cap, even when torn, to take the same position it had before the tear-off, thus constituting a reclosure in an "active" rather than passive sense.

Also according to the invention, the tear-off band can be delimited by two lines of incision which constitute the extensions of the pullout tongue edges and which stop at the part opposite said tongue before reaching the free edge of the circumferential flap.

The present invention will be hereinafter further clarified in one of its preferred forms of practical embodiment illustrated purely by way of example and not restrictively with reference to the attached table of drawings, in which.

Figure 1:
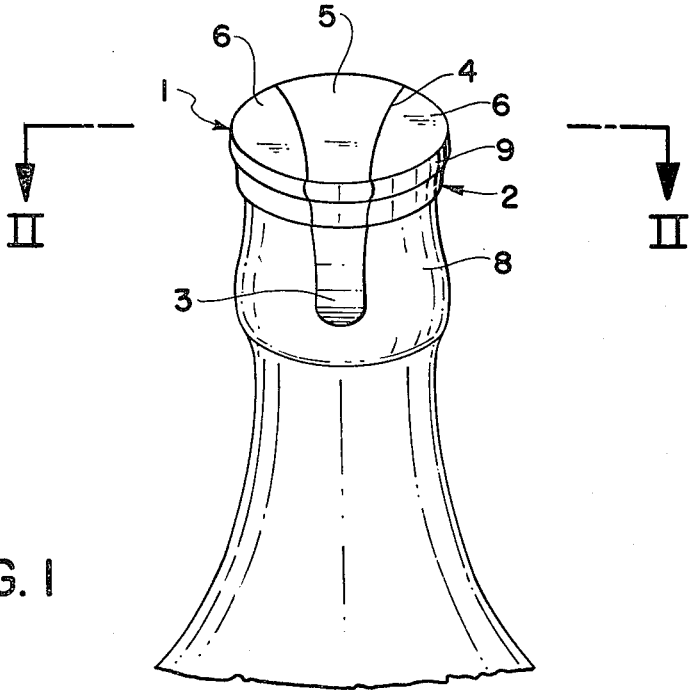
FIG. 1 shows in perspective a cap according to the invention applied to a bottle.
Figure 2:
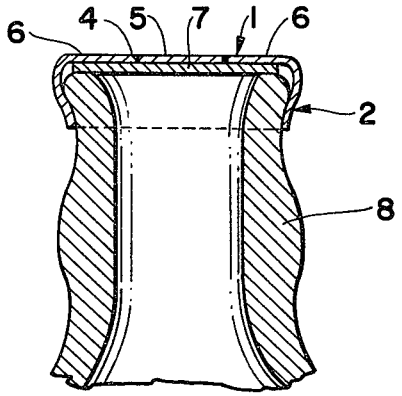
FIG. 2 shows it according to transversal section II—II of FIG. 1.
Figure 3:
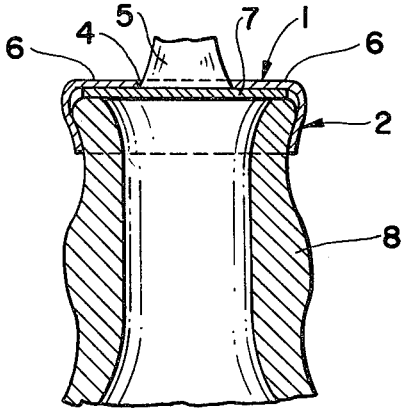
FIG. 3 shows it in the same view of FIG. 2 after tear-off and subsequent reapplication to the neck of the bottle.

As seen in the figures, the tear-off cap according to the invention is made of a metal material and consists of a disc-shaped flat upper part 1 encircled by a perimetric flap 2 turned downward. Starting from one zone of the flap is a pullout tongue 3, the edges of which extend along two lines of incision 4 which completely cross the flap 2 itself and the disc-shaped part 1, stopping on said flap in a position opposite the tongue 3. The two incisions 4 therefore form a tear-off band 5, which basically constitutes the extension of the tongue 3 on the disc-shaped part 1, and two lateral parts 6.

On the disc-shaped part 1 is applied a seal gasket 7. It is fastened to the bottom surface of said circular part but only to the two lateral parts 6, thus leaving completely free the tear-off band 5 and the two incisions 4 which delimit it.

For the first application to the neck of the bottle, the cap according to the invention requires the same operations that are traditionally required by other caps and which therefore have no need of further description.

Also at the moment of pullout, the operations that the user must do are basically the same. It should be noted here that the stopping of the incisions 4 at the position opposite the tongue 3 allows the torn cap to remain in one piece.

The cap is removed from the neck 8 of the bottle thanks to the elastic yielding of the disc-shaped gasket 7, which enables the separation of the two opposite sections 9 of the flap, with the relative parts 6, from the neck 8 of the bottle.

After the cap has been completely removed, the elasticity of the gasket 7 brings those flap sections 9 back to their original position. In reapplying the cap to the bottle, the operation can be easily and effectively done by gently pulling apart the two sections 9 of the flap 2 and thus subjecting to tension of the disc-shaped gasket 7 which, once the cap has been reapplied, brings both sections 9 back to the original closure position.

In summary, in the cap according to the invention, the disc-shaped gasket 7 performs, besides the traditional function consisting in assuring a closing seal, the new function of elastically preserving the original shape of the cap and thus affording an almost unlimited number of active reclosings.

The present invention has been illustrated and described in one of its preferred forms of embodiment, but naturally there are variations which can be applied in practice, without departing from the spirit or scope of the invention.

I claim:

1. A light metal tear-off cap for closing bottles comprising a circumferential flap and a flat disc-shaped part, a tear-off band crosses the disc-shaped part and circumferential flap and extends beyond the same in a pullout tongue, a disc-shaped gasket fastened only partially to the bottom surface of the metal disc-shaped part characterized in that said disc-shaped gasket is fastened to said metal disc-shaped part only in zones disposed laterally of and outside the tear-off band.

2. A cap according to claim 1 characterized in that the tear-off band is delimited by two lines of incision which constitute the extensions of the edges of the pull out tongue and which stop at the circumferential flap opposite said tongue before reaching the free edge of the circumferential flap.

3. A cap according to claim 2 characterized in that the tear-off band delimits in the disc-shaped part two equally shaped zones.

4. A light metal tear-off cap for closing bottles comprising a flat disc-shaped part surrounded by a circumferential flap, a tear-off band formed in said disc-shaped part and circumferential flap and extending therebeyond in a pullout tongue, a circular gasket disposed within said cap having only a portion fastened to the interior surface of said cap characterized in that said gasket is fastened to said cap interior in spaced zones separated from each other by unfastened portions of said gasket in said tear-off band.

* * * * *